US009201339B2

(12) United States Patent
Kobayashi

(10) Patent No.: US 9,201,339 B2
(45) Date of Patent: Dec. 1, 2015

(54) IMAGE FORMING APPARATUS MEASURING DEVELOPER AMOUNT IN DEVELOPING DEVICE ON THE BASIS OF DUTY RATIO OF MAGNETIC PERMEABILITY OF DEVELOPER IN DEVELOPING DEVICE

(71) Applicant: KYOCERA Document Solutions Inc., Osaka (JP)

(72) Inventor: Kimihiko Kobayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/310,123

(22) Filed: Jun. 20, 2014

(65) Prior Publication Data

US 2015/0003849 A1 Jan. 1, 2015

(30) Foreign Application Priority Data

Jul. 1, 2013 (JP) ..... 2013-137687

(51) Int. Cl.
*G03G 15/08* (2006.01)

(52) U.S. Cl.
CPC ..... *G03G 15/086* (2013.01); *G03G 15/0889* (2013.01)

(58) Field of Classification Search
CPC ..... G03G 15/0829; G03G 15/0853; G03G 15/086
USPC ..... 399/27, 63
See application file for complete search history.

(56) References Cited

U.S. PATENT DOCUMENTS 4,506,804 A * 3/1985 Oka
4,974,025 A * 11/1990 Kikuchi
5,049,938 A * 9/1991 Ueda

FOREIGN PATENT DOCUMENTS

JP H09-281786 A 10/1997

* cited by examiner

*Primary Examiner* — Walter L Lindsay, Jr.
*Assistant Examiner* — Milton Gonzalez
(74) *Attorney, Agent, or Firm* — Studebaker & Brackett PC

(57) ABSTRACT

An image forming apparatus includes a developing device, a magnetic permeability detecting part and a developer amount measuring part. The developing device develops an image carrier by a contained developer. The magnetic permeability detecting part detects magnetic permeability of the developer in the developing device. The developer amount measuring part calculates a duty ratio of the magnetic permeability of the developer in the developing device on the basis of detected result of the magnetic permeability detecting part and measures a developer amount in the developing device on the basis of the duty ratio.

5 Claims, 7 Drawing Sheets

IMAGE FORMING APPARATUS MEASURING DEVELOPER AMOUNT IN DEVELOPING DEVICE ON THE BASIS OF DUTY RATIO OF MAGNETIC PERMEABILITY OF DEVELOPER IN DEVELOPING DEVICE

INCORPORATION BY REFERENCE

This application is based on and claims the benefit of priority from Japanese Patent application No. 2013-137687 filed on Jul. 1, 2013, the entire contents of which are incorporated herein by reference.

BACKGROUND

The present disclosure relates to an image forming apparatus capable of measuring a developer amount in a developing device.

An image forming apparatus forms an image, such as a toner image or the like, on a photosensitive drum by developing an electrostatic latent image formed on the photosensitive drum by a developing device using a developer, such as a toner. This image is transferred to a sheet by a transferring part and fixed by a fixing part, and then, ejected outside the image forming apparatus.

The developing device includes a toner sensor detecting whether or not a sufficient amount of the toner is contained in a housing. The toner sensor detects, for example, magnetic permeability of a magnetic field produced by the toner in the developing device, and then, the image forming apparatus measures the toner amount in the developing device on the basis of output voltage according to a detected result of the toner sensor. When the sufficient amount of the toner cannot be detected by the toner sensor, the image forming apparatus controls so as to replenish the developing device with the toner. Thus, the toner amount in the developing device is kept constant and a desired image may be formed excellently.

For example, there is an image forming apparatus including a toner end detecting device. The toner end detecting device utilizes variation of analog output voltage of the toner sensor according to rotation of an agitator in a toner containing channel to detect a toner end from the variation of the analog output voltage, i.e., from a difference between a maximum value and a minimum value of the analog output voltage, and accordingly, to suppress dispersion of toner end detection caused by difference of output characteristics of the toner sensor.

However, in the above-mentioned image forming apparatus including the toner sensor detecting the magnetic permeability, in a case where an electric equipment, which includes a transformer or a coil, or a magnetic body such as a magnet, which emits a leaked magnetic flux, is arranged near the image forming apparatus, particularly near the toner sensor, there are possibilities of, by the influence of the magnetic flux, detecting magnetic permeability higher than the magnetic permeability of the toner and increasing sensor output. If the sensor output is increased by the influence of such external environment, the output voltage may exceed limit value of the toner sensor or a detecting part in the image forming apparatus, and therefore, correct maximum value cannot be confirmed and correct toner amount cannot be measured.

SUMMARY

In accordance with an embodiment of the present disclosure, an image forming apparatus includes a developing device, a magnetic permeability detecting part and a developer amount measuring part. The developing device develops an image carrier by a contained developer. The magnetic permeability detecting part detects magnetic permeability of the developer in the developing device. The developer amount measuring part calculates a duty ratio of the magnetic permeability of the developer in the developing device on the basis of detected result of the magnetic permeability detecting part and measures a developer amount in the developing device on the basis of the duty ratio.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
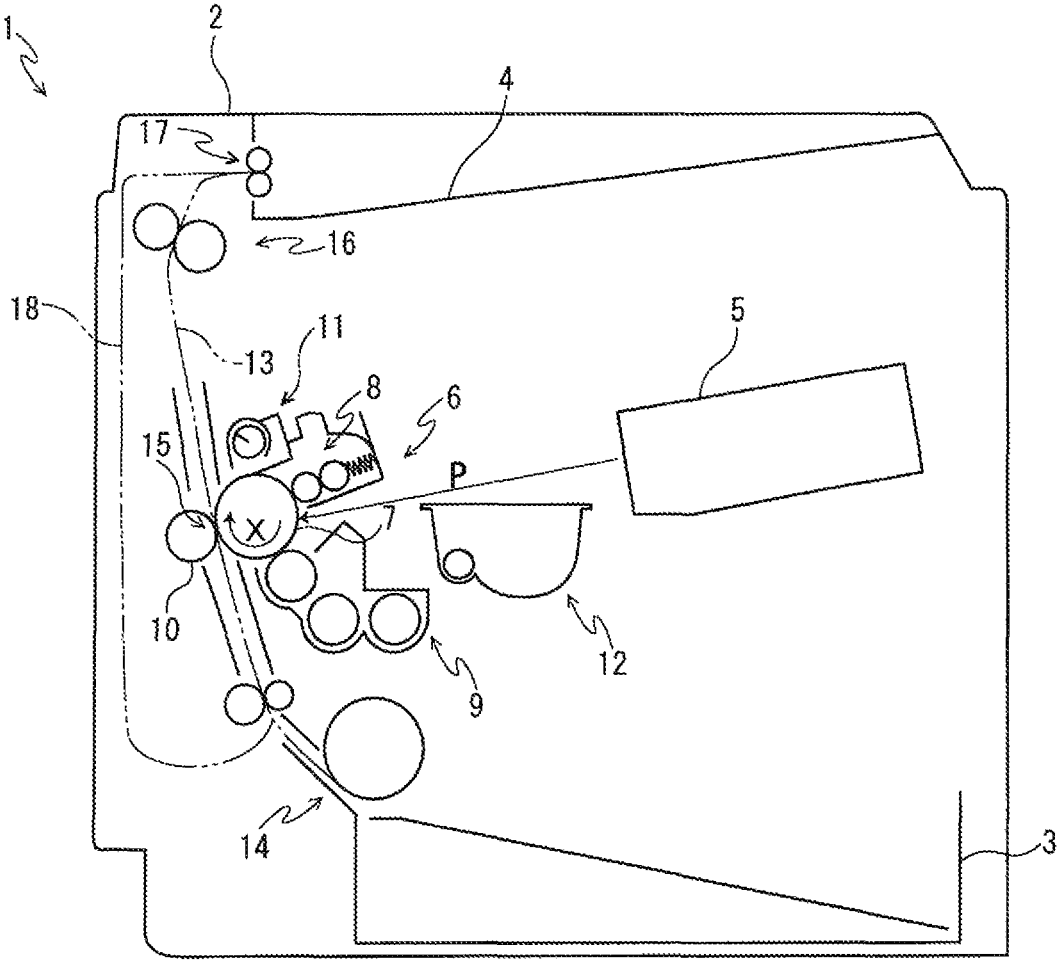
FIG. 1 is a schematic diagram schematically showing a printer in accordance with an embodiment of the present disclosure.

First, with reference to FIG. 1, the entire structure of a printer 1 as an image forming apparatus will be described. FIG. 1 is a schematic diagram schematically showing the printer according to an embodiment of the present disclosure. Hereinafter, it will be described so that the front side of the printer 1 is positioned at the right-hand side of FIG. 1. In the printer 1 of the embodiment, development is carried out by using a magnetic single-component toner (a developer).

As shown in FIG. 1, the printer 1 includes a box-formed printer main body 2. In a lower part of the printer main body 2, a sheet feeding cartridge 3 storing sheets (not shown) is installed and, in a top face of the printer main body 2, a sheet ejected tray 4 is formed.

In an upper forward part of the printer main body 2, an exposure device 5 having a laser scanning unit (LSU) is installed. In a rear part of the printer main body 2, an image forming unit 6 is arranged. In the image forming unit 6, a photosensitive drum 7 as an image carrier is rotatably installed. Around the photosensitive drum 7, a charger 8, a developing device 9, a transfer roller 10 and a cleaning device 11 are located along a rotating direction (refer to an arrow X in FIG. 1) of the photosensitive drum 7. The developing device 9 is installed to an installed part (not shown) in the printer 1 so as to be adjacent to the photosensitive drum 7 and connected to a toner case 12, such as a toner container, in order to receive supply of the toner.

In the rear part of the printer main body 2, a sheet conveying path 13 is arranged from a lower side to an upper side. That is, the printer 1 is configured in a vertical conveying manner. At an upstream end in the conveying path 13, a sheet feeder 14 is positioned. At an intermediate stream part in the conveying path 13, a transferring part 15 composed of the photosensitive drum 7 and transfer roller 10 is positioned. At a downstream part in the conveying path 13, a fixing part 16 is positioned. At a downstream end in the conveying path 13, a sheet ejecting part 17 is positioned. In the rear of the conveying path 13, an inversion path 18 for duplex printing is arranged.

Next, the operation of forming an image by the printer 1 having such a configuration will be described.

When the power is supplied to the printer 1, various parameters are initialized and initial determination, such as temperature determination of the fixing part 16, is carried out. Subsequently, in the printer 1, when image data is inputted and a printing start is directed from a computer or the like connected with the printer 1, image forming operation is carried out as follows.

First, the surface of the photosensitive drum 7 is uniformly electric-charged by the charger 8. Then, exposure corresponding to the image data on the photosensitive drum 7 is carried out by a laser light P from the exposure device 5, thereby forming an electrostatic latent image on the surface of the photosensitive drum 7. Subsequently, the electrostatic latent image is developed by the toner supplied from the developing device 9 to the photosensitive drum 7, and thereby, a toner image is generated.

On the other hand, a sheet fed from the sheet feeding cartridge 3 by the sheet feeder 14 is conveyed to the transferring part 15 in a suitable timing for the above-mentioned image forming operation, and then, the toner image on the photosensitive drum 7 is transferred onto the sheet in the transferring part 15. The sheet with the transferred toner image is conveyed to a downstream side in the conveying path 13 to go forward to the fixing part 16, and then, the toner image is fixed on the sheet in the fixing part 16. The sheet with the fixed toner image is ejected from the sheet ejecting part to the sheet ejected tray 4. The toner remained on the photosensitive drum 7 is removed by the cleaning device 11.

Figure 2:
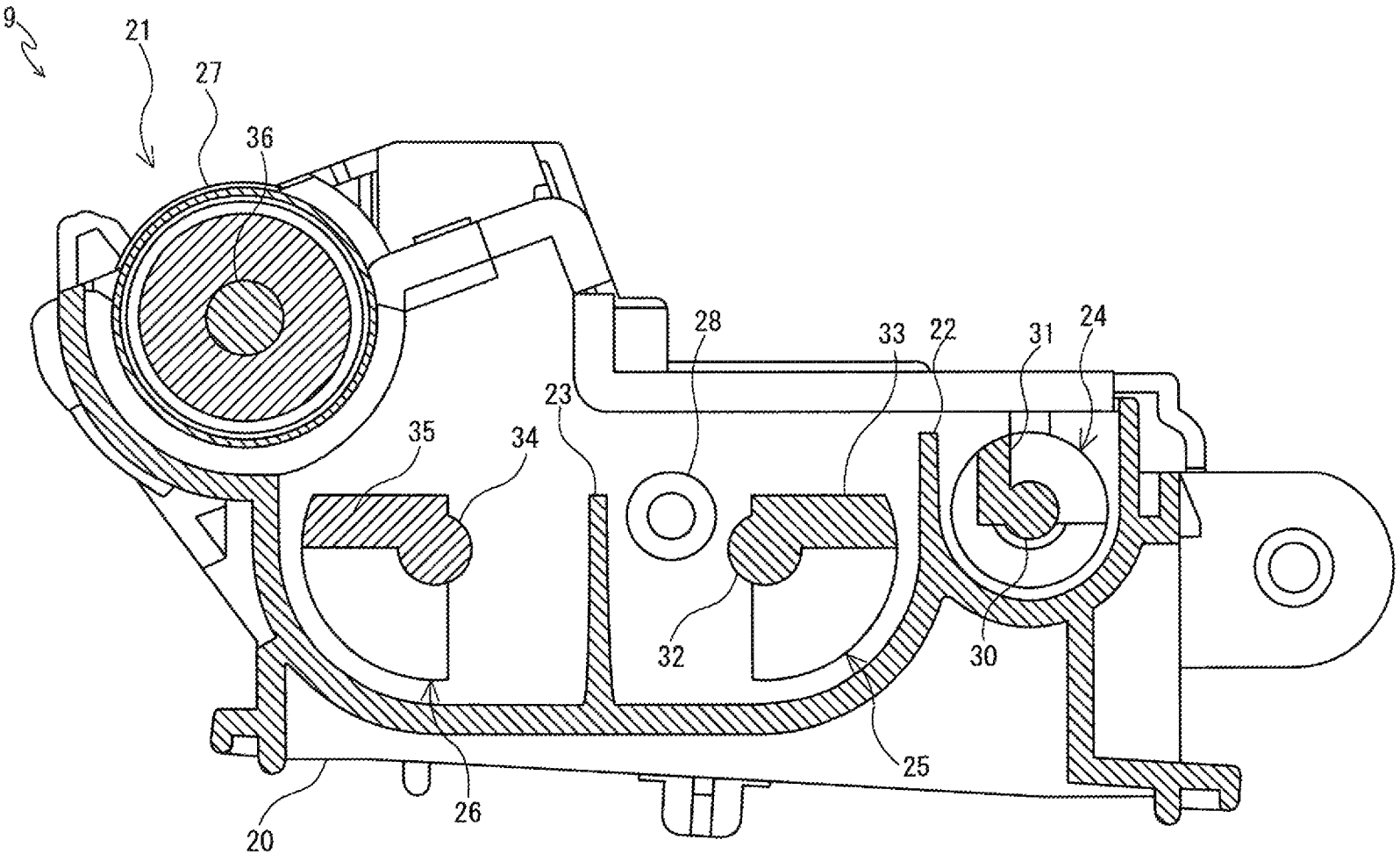
FIG. 2 is a sectional view of a developing device in the printer in accordance with the embodiment of the present disclosure.

Next, with reference to FIG. 2, the developing device 9 will be described in detail. FIG. 2 is a sectional view of a developing device in the printer in accordance with the embodiment of the present disclosure.

As shown in FIG. 2, the developing device 9 includes a housing (case) 20 having an opening part 21 and is arranged so that the opening part 21 faces to the photosensitive drum 7 (refer to FIG. 1).

In an upper part of the housing 20, a supply port (not shown) is opened. The housing 20 is connected to the toner case 12 via this supply port to receive toner supply. On a bottom part of the housing 20, a first partition 22 is provided between a conveying screw 24 and a first agitating screw 25 mentioned below and a second partition 23 is provided between the first agitating screw 25 and a second agitating screw 26. For example, the first partition 22 has a gap (not shown) used for conveying the toner from the conveying screw 24 to the first agitating screw 25 in the vicinity of the above-mentioned supply port. The second partition 23 has gaps (not shown) used for conveying the developer from the first agitating screw 25 to the second agitating screw 26 in both ends.

The developing device 9 includes the conveying screw 24, first agitating screw (an agitating member) 25, second agitating screw (an agitating member) 26 and a developing roller 27 inside the housing 20. The developing device 9 also includes a toner sensor (a magnetic permeability detecting part) 28 detecting magnetic permeability according to a toner amount in the housing 20.

Figure 3:
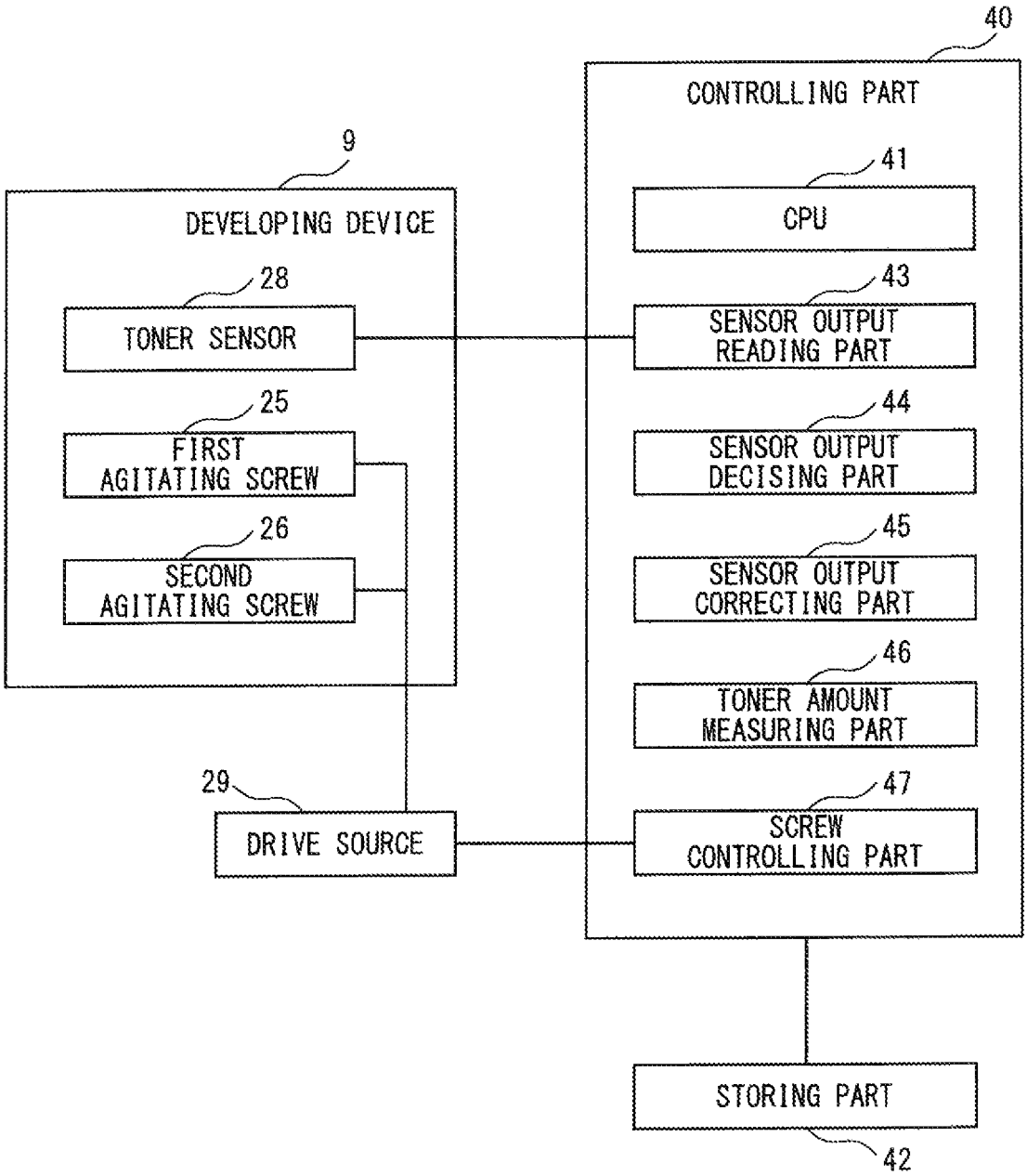
FIG. 3 is a block diagram schematically showing a developing device and a controlling part controlling this developing device in the printer in accordance with the embodiment of the present disclosure.

For example, the developing device 9 is configured to input drive force from a drive source 29 (refer to FIG. 3), such as a motor, installed in the printer 1 and to transmit the drive force to the conveying screw 24, first agitating screw 25, second agitating screw 26 and developing roller 27. In FIG. 3, connection of the drive source 29 to the first agitating screw 25 and second agitating screw 26 is shown, but connection of the drive source 29 to the conveying screw 24 and developing roller 27 is omitted.

The conveying screw 24 includes a conveying rotation shaft 30 and a helical conveying vane member 31 provided around the conveying rotation shaft 30. The conveying screw 24 is rotatably provided in a front end portion of the housing 20 at the opposite side to the opening part 21. For example, the conveying vane member 31 is provided in an end part in an axial direction of the conveying rotation shaft 30. Another end part in the axial direction of the conveying rotation shaft 30 is configured to input the drive force from the drive source 29.

That is, in the conveying screw 24, the conveying rotation shaft 30 rotates together with the conveying vane member 31 by the drive force from the drive source 29, and then, the conveying screw 24 uses rotation of the conveying vane member 31 to convey the toner supplied through the supply port via the gap of the first partition 22 to the first agitating screw 25.

The first agitating screw 25 includes a first agitating rotation shaft 32 and a helical first agitating vane member 33 provided around the first agitating rotation shaft 32. The second agitating screw 25 includes a second agitating rotation shaft 34 and a helical second agitating vane member 35 provided around the second agitating rotation shaft 34. The first agitating screw 25 is arranged in the rear of the conveying screw 24 so as to be parallel and adjacent to the conveying screw 24. The second agitating screw 26 is arranged in the rear of the first agitating screw 25 so as to be parallel and adjacent to the first agitating screw 25. The first agitating screw 25 and second agitating screw 26 are rotatably provided in a bottom part of the housing 20. The first agitating vane member 33 and second agitating vane member 35 are provided from one ends to other ends of the first agitating rotation shaft 32 and second agitating rotation shaft 34, respectively, and formed in respective helical shapes. For example, the other ends of the first agitating rotation shaft 32 and second agitating rotation shaft 34 are configured so as to input the drive force from the drive source 29.

That is, in the first agitating screw 25, the first agitating rotation shaft 32 is rotated together with the first agitating vane member 33 by the drive force from the drive source 29, and then, the first agitating screw 25 uses rotation of the first agitating vane member 33 to agitate the toner conveyed from the conveying screw 24 and simultaneously to convey the toner via one gap of the second partition 23 to the second agitating screw 26. Moreover, in the second agitating screw 26, the second agitating rotation shaft 34 is rotated together with the second agitating vane member 35 by the drive force from the drive source 29, and then, the second agitating screw 26 uses rotation of the second agitating vane member 35 to agitate the toner conveyed from the first agitating screw 25 and simultaneously to convey the toner to the developing roller 27.

The developing roller 27 is arranged in a rear end part of the housing 20 so as to be in parallel to and adjacent to a rear side of the second agitating screw 26. The developing roller 27 includes a development rotation shaft 36, thereby being arranged rotatable. A part of a rotation surface of the developing roller 27 is exposed through the opening part 21. The developing roller 27 and the photosensitive drum 7 are disposed adjacent to each other so that their rotation surfaces face to each other. For example, an end part of the development rotation shaft 36 is configured to input the drive force from the drive source 29.

That is, in the developing roller 27, as the development rotation shaft 36 is rotated by the drive force transmitted from the drive source 29, the toner conveyed from the second agitating screw 26 is carried on the surface of the developing roller 27. Furthermore, the developing roller 27 supplies the carrying toner to the adjacent photosensitive drum 7 via the opening part 21 so that an electrostatic latent image formed on the surface of the photosensitive drum 7 is developed.

Incidentally, the toner that is not carried by the developing roller 27 because a predetermined amount is exceeded, that is, surplus toner, is returned to the second agitating screw 26, and returned from which to the first agitating screw 25 via the other gap of the second partition 23. In this manner, the first agitating screw 25 and second agitating screw 26 convey and agitate the toner supplied from the toner case 12.

The toner sensor 28 is buried in an inside face of an upper part of the housing 20 between the first agitating screw 25 and second agitating screw 26. The toner sensor 28 is a magnetic permeability detecting device detects magnetic permeability of a magnetic field produced near the toner sensor 28 by the toner in the housing 20. For example, in a case of the magnetic single-component toner, the magnetic permeability is heightened as the toner amount is increased, while the magnetic permeability is lowered as the toner amount is decreased. Therefore, the toner sensor 28 arranged in the upper part of the housing 20 detects the high magnetic permeability when the sufficient amount of the toner is contained, for example, so as to reach the upper part in the housing 20, while the low high magnetic permeability when the insufficient amount of the toner is contained, for example, so as to not reach the upper part in the housing 20. In a case where the toner in the housing 20 is scraped up by the first agitating screw 25 and second agitating screw 26 to come near the toner sensor 28, the toner sensor 28 detects the high magnetic permeability.

The toner sensor 28 is electrically connected to a controlling part 40 (refer to FIG. 3) of the printer 1 to output voltage according to the detected magnetic permeability as sensor output to the controlling part 40 (refer to FIG. 3). The controlling part 40 measures the toner amount in the housing 20 on the basis of a duty ratio of the sensor output of the toner sensor 28, i.e., a duty ratio of the magnetic permeability.

Next, with reference to FIG. 3, the controlling part 40 will be described in detail. FIG. 3 is a block diagram schematically showing a developing device and a controlling part controlling this developing device in the printer in accordance with the embodiment of the present disclosure.

The controlling part 40 controls integratedly each operation of the printer 1. The controlling part 40 includes a central processing unit (CPU), for example, to process each operation by executing programs stored in a storing part 42. The controlling part 40 includes a sensor output reading part 43, a sensor output deciding part (a detected result deciding part) 44, a sensor output correcting part (a detected result correcting part) 45, a toner amount measuring part (a developer amount measuring part) 46 and a screw controlling part 47. For example, the sensor output reading part 43, sensor output deciding part 44, sensor output correcting part 45, toner amount measuring part 46 and screw controlling part 47 are composed of respective programs stored in the storing part 42 to be executable by the CPU 41.

The sensor output reading part 43 is configured to read the sensor output of the toner sensor 28. For example, the sensor output reading part 43 carries out detection instruction to the toner sensor 28 and receives the voltage according to the magnetic permeability in the developing device 9 as the detected result from the toner sensor 28.

The sensor output deciding part 44 monitors the sensor output (the magnetic permeability in the developing device 9) of the toner sensor 28 read by the sensor output reading part 43 before toner agitation in the developing device 9 (in a non-agitation state) and decides whether or not the sensor output is changed in time (varied).

In a case where the sensor output is varied before the toner agitation, since it is possible to decide that influence of external environment is caused on magnetic permeability detection in the toner sensor 28, the sensor output deciding part 44 decides whether or not there is cyclicity in respect to the variation. For example, the sensor output deciding part 44 monitors the sensor output of the toner sensor 28 for a predetermined long time, e.g., for one minute, cuts out a partial arrangement from a piece of monitored data and confirms whether or not there is another arrangement matching to this arrangement. At this time, if there is the matching arrangement, assuming that a period from the cutout arrangement to the matching arrangement is one cycle, the sensor output deciding part 44 compares one data arrangement corresponding to this one cycle with other data arrangement corresponding to next one cycle, and then, decides, when both data arrangement are roughly equal, that there is the cyclicity. Moreover, in a case where there is the cyclicity in respect to the variation of the sensor output, since it is possible to decide that the sensor output can be corrected so as to remove the influence of the external environment, the sensor output deciding part 44 carries out correction instruction to the sensor output correcting part 45. On the other hand, in a case where there is no cyclicity in respect to the variation of the sensor output, i.e., in a case where the variation of the sensor output is random, since it is possible to decide that the sensor output cannot be corrected so as to remove the influence of the external environment, the controlling part 40 carries out error notification by a warning part (not shown).

In a case where the sensor output is not varied, the sensor output deciding part 44 compares the voltage according to the magnetic permeability as the sensor output of the toner sensor 28 with power supply voltage Vs. If the sensor output is roughly equal to the power supply voltage Vs (limit value), e.g., within the range of ±0.3V from the power supply voltage Vs, since it is possible to decide that the influence of the external environment is caused on the sensor output and that the voltage is so increased that HIGH and LOW levels of the sensor output cannot be distinguished and the duty ratio cannot be calculated, the controlling part 40 carries out the error notification by the warning part (not shown). On the other hand, if the sensor output is sufficiently less than the power supply voltage Vs, the sensor output deciding part 44 carries out the correction instruction to the sensor output correcting part 45 or carries out measurement instruction to the toner amount measuring part 46 without the correction instruction.

The sensor output correcting part 45 reads the sensor output of the toner sensor 28 by the sensor output reading part 43 during the toner agitation in the developing device 9 (in an agitation state) and corrects the sensor output by subtracting the sensor output before the toner agitation from the sensor output during the toner agitation. For example, the sensor output correcting part 45 obtains the sensor output of the toner sensor 28 at the same period as the agitation cycle of the first agitating screw 25 and second agitating screw 26 or period corresponding to several repeats of the agitation cycle and corrects the sensor output by the above-mentioned subtraction.

The toner amount measuring part 46 calculates the duty ratio in respect to the sensor output (the magnetic permeability) corrected by the sensor output correcting part 45 in the agitation cycle of the first agitating screw 25 and second agitating screw 26 and measures the toner amount in the housing 20 on the basis of this duty ratio.

The screw controlling part 47 is connected to the drive source 29 to input drive signal to the drive source 29 when driving the conveying screw 24, first agitating screw 25, second agitating screw 26 and a developing roller 27.

Figure 4:
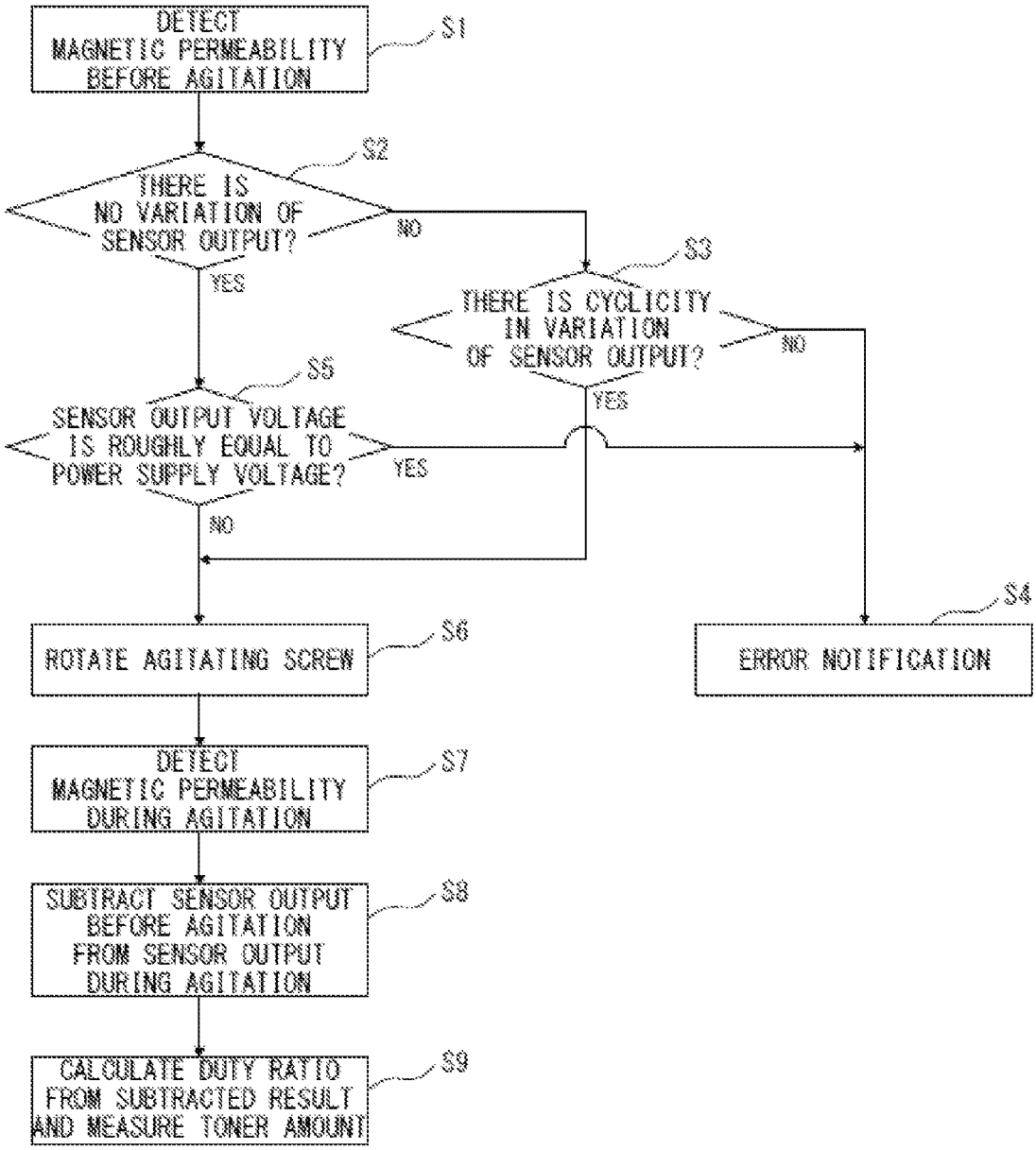
FIG. 4 is a flowchart illustrating measuring process of a toner amount in the developing device in the printer in accordance with the embodiment of the present disclosure.

Next, toner amount measuring operation in the printer 1 provided with such a configuration will be described with reference to flowchart of FIG. 4.

First, in the printer 1, before the first agitating screw 25 and second agitating screw 26 are driven (before the toner agitation), the sensor output reading part 43 of the controlling part 40 carries out the detection instruction to the toner sensor 28. The toner sensor 28 detects the magnetic permeability near the toner sensor 28 in the housing 20 of the developing device 9 in accordance with the detection instruction from the sensor output reading part 43. Then, the sensor output reading part 43 reads the sensor output according to the magnetic permeability from the toner sensor 28 (step S1).

Figure 5:
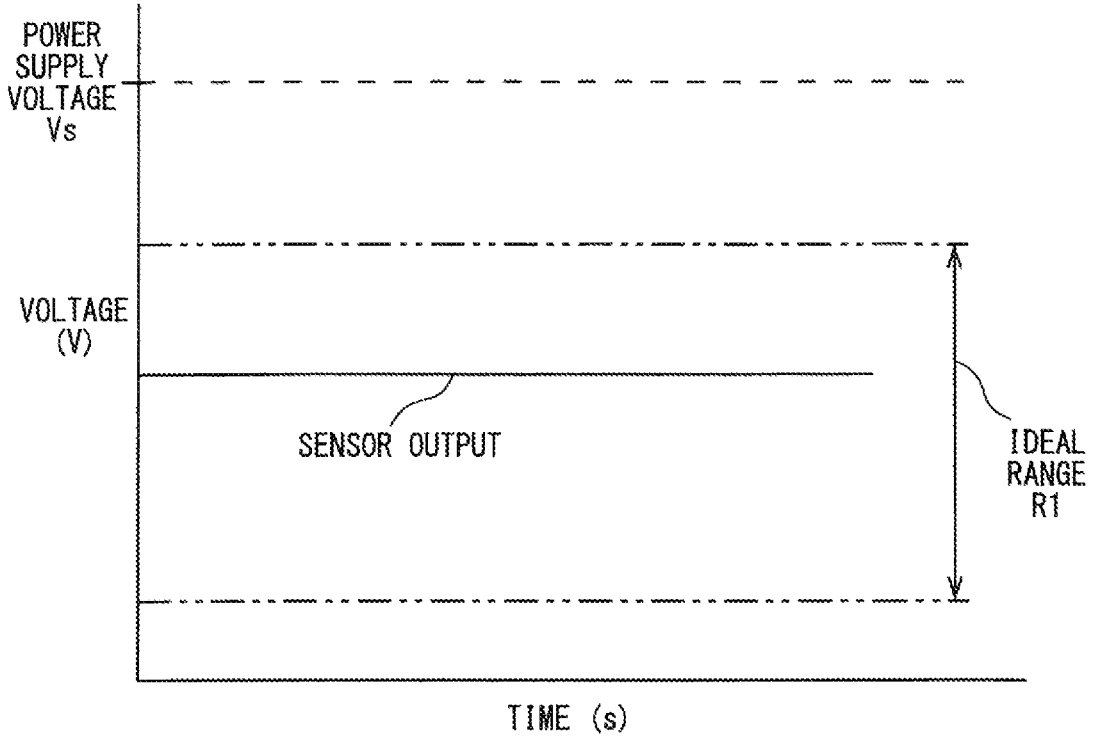
FIG. 5 is a graph plotting toner sensor output about the developing device before toner agitation, in a case where there is no influence of external environment, in the printer in accordance with the embodiment of the present disclosure.
Figure 6:
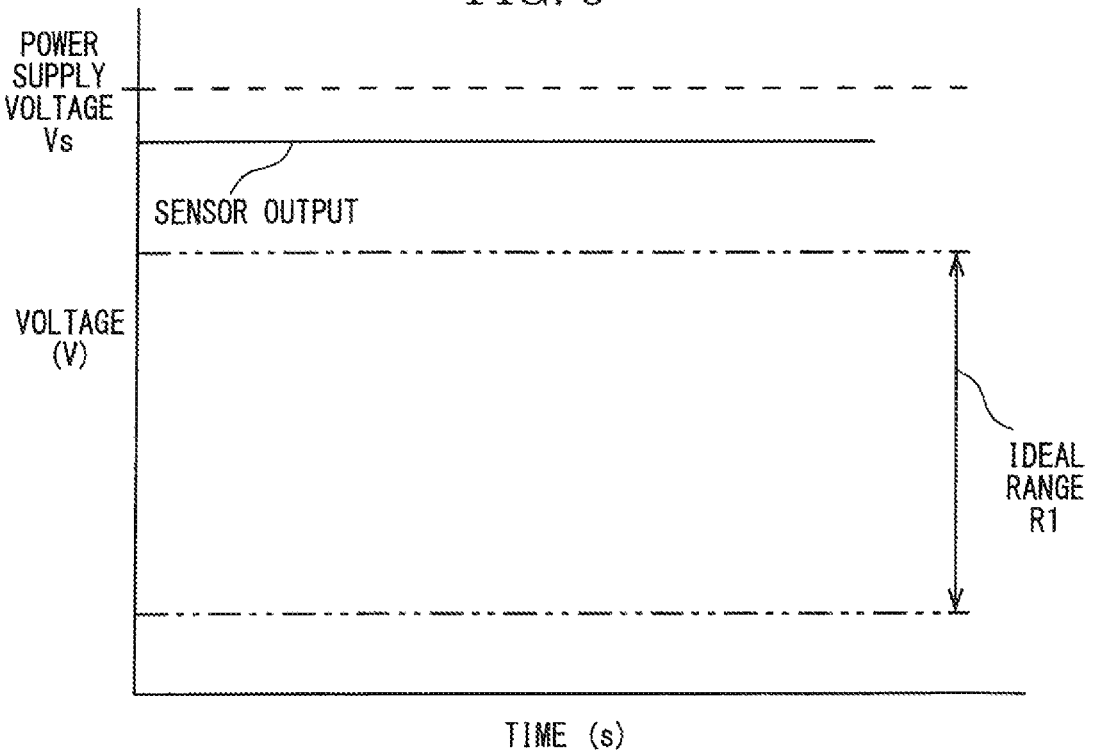
FIG. 6 is a graph plotting the toner sensor output about the developing device before the toner agitation, in a case where there is an influence of the external environment, in the printer in accordance with the embodiment of the present disclosure.

At this time, in a case where the influence of the external environment is not caused on the sensor output of the toner sensor 28, for example, as shown in FIG. 5, the sensor output is kept in an ideal range R1. On the other hand, in a case where, since an electric equipment including a transformer or a coil, or a magnetic body such as a magnet, is arranged near the toner sensor 28, the influence of the external environment is caused on the sensor output of the toner sensor 28, a magnetic flux produced near the toner sensor 28 is increased due to the influence of the external environment. Accordingly, for example, as shown in FIG. 6, voltage corresponding to the increase is superimposed on the output voltage according to the magnetic permeability of the toner in the housing 20, and therefore, the sensor output is increased to exceed the ideal range R1 and often to reach almost the power supply voltage Vs.

Next, the sensor output deciding part 44 of the controlling part 40 decides whether or not the sensor output (the sensor output before the agitation) of the toner sensor 28 read by the sensor output reading part 43 before the toner agitation is varied (step S2).

In a case where the sensor output is varied before the toner agitation (step S2: NO), the sensor output deciding part 44 decides whether or not there is cyclicity in respect to the variation (step S3). Moreover, in a case where there is cyclicity in respect to the variation of the sensor output (step S3: YES), the operation shifts to step S6 in order to carry out correcting process of the sensor output mentioned below. On the other hand, in a case where there is no cyclicity in respect to the variation of the sensor output (step S3: NO), the controlling part 40 carries out the error notification to a user by the warning part (step S4).

By contrast, in a case where the sensor output is not varied before the toner agitation (step S2: YES), the sensor output deciding part 44 compares the output voltage as the sensor output with the power supply voltage Vs (step S5). Moreover, in a case where the sensor output is roughly equal to the power supply voltage Vs (step S5: YES), the controlling part 40 carries out the error notification to a user by the warning part (step S4). On the other hand, in a case where the sensor output is sufficiently less than the power supply voltage Vs (step S5: NO), the operation shifts to step S6 in order to carry out the correcting process of the sensor output mentioned below.

In the correcting process (step S6) of the sensor output, first, the screw controlling part 47 of the controlling part 40 activates the drive source 29 to drive the driving the conveying screw 24, first agitating screw 25, second agitating screw 26 and a developing roller 27. Thereby, the toner in the housing 20 is agitated by the first agitating screw 25 and second agitating screw 26.

Next, during such a toner agitation of the developing device 9, the sensor output reading part 43 of the controlling part 40 reads the sensor output of the toner sensor 28 (step S7).

Figure 7:
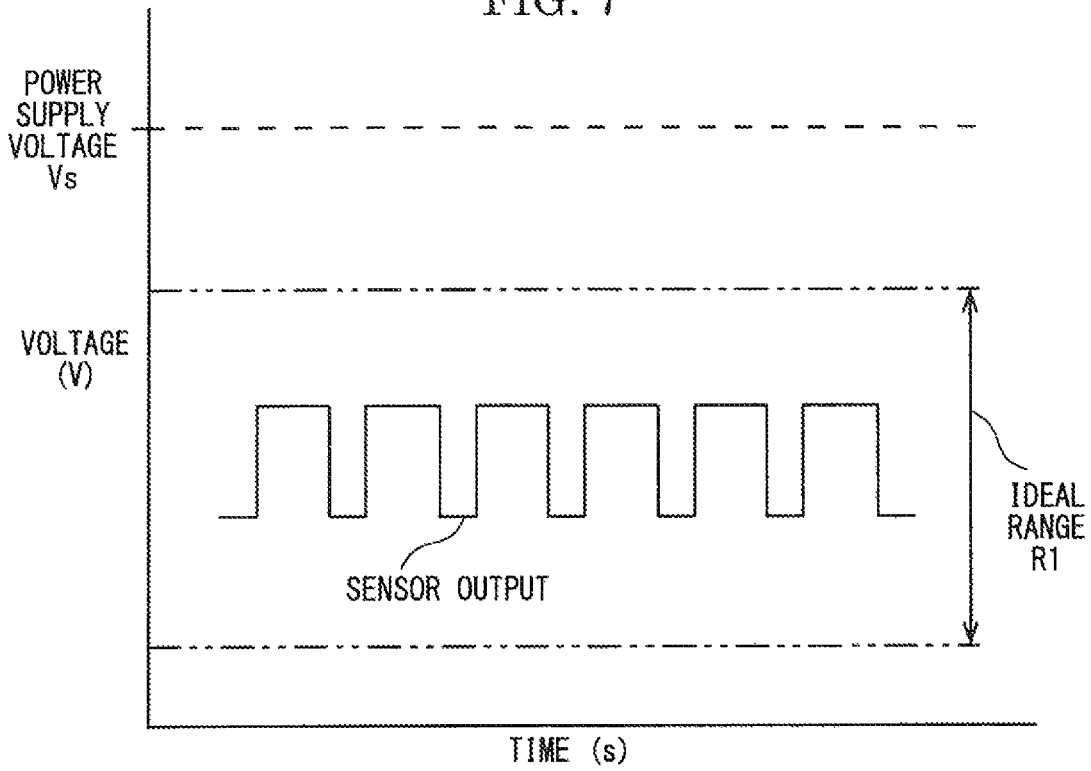
FIG. 7 is a graph plotting the toner sensor output about the developing device during the toner agitation, in the case where there is no influence of the external environment, in the printer in accordance with the embodiment of the present disclosure.
Figure 8:
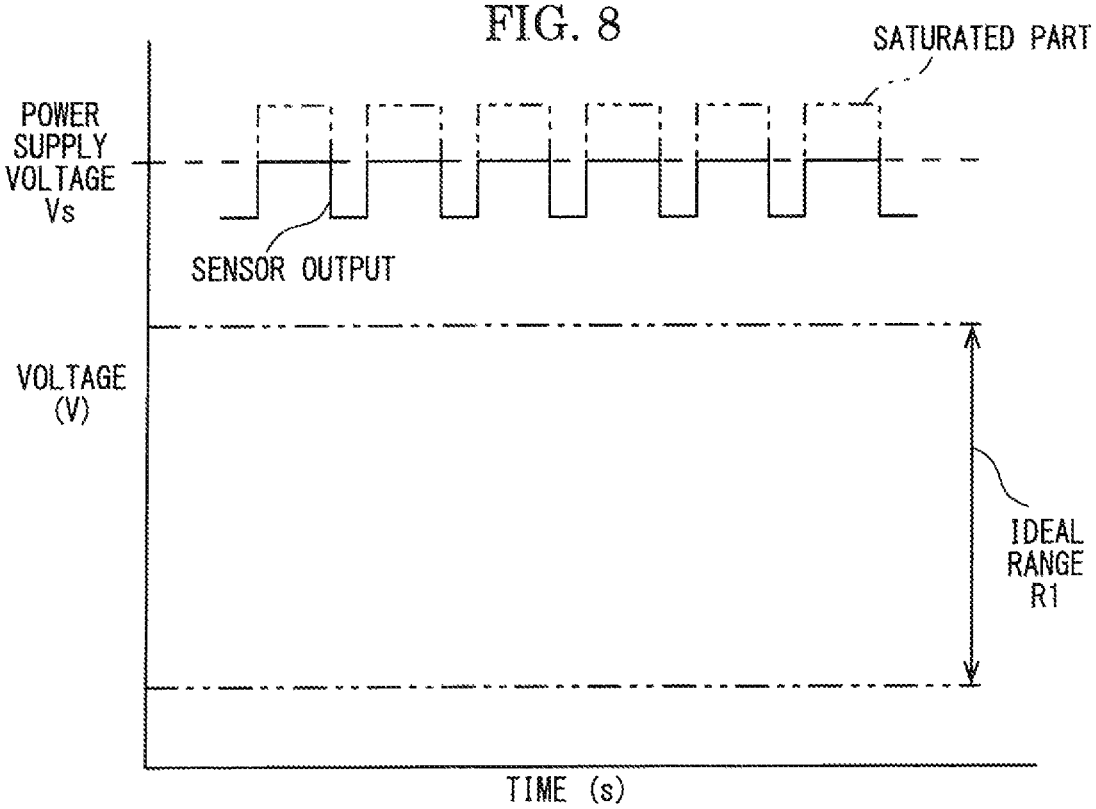
FIG. 8 is a graph plotting the toner sensor output about the developing device during the toner agitation, in the case where there is the influence of the external environment, in the printer in accordance with the embodiment of the present disclosure.

At this time, for example, as shown in FIG. 7, while the sensor output is varied in the agitation cycle because of upward/downward movement of the toner according to the agitation, if the influence of the external environment is not caused on the sensor output of the toner sensor 28, the sensor output is kept in an ideal range R1. On the other hand, if the influence of the external environment is caused on the sensor output of the toner sensor 28 and the output voltage is increased, for example, as shown in FIG. 8, the sensor output exceeds the ideal range R1 so that the maximum value often reaches the power supply voltage Vs. When the sensor output of the toner sensor 28 reaches the power supply voltage Vs as the limit value, the sensor output is saturated. Therefore, since the toner sensor 28 cannot output voltage more than the limit value, correct sensor output may be obtained.

Then, the sensor output correcting part 45 of the controlling part 40 corrects the sensor output by subtracting the sensor output before the toner agitation from the sensor output during the toner agitation (step S8).

In addition, the toner amount measuring part 46 calculates the duty ratio in respect to the sensor output corrected by the sensor output correcting part 45 in the agitation cycle T1 (refer to FIG. 9) of the first agitating screw 25 and second agitating screw 26 and measures the toner amount in the housing 20 on the basis of this duty ratio (step S9).

Figure 9:
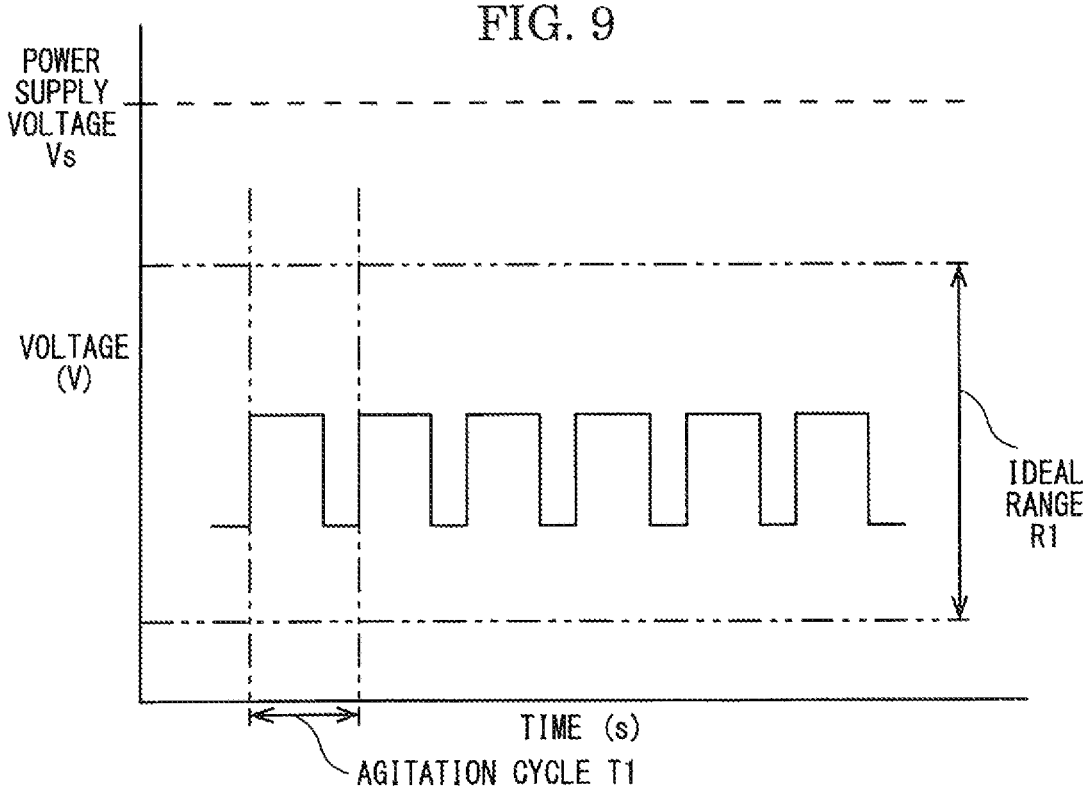
FIG. 9 is a graph plotting the toner sensor output, in a case where a duty ratio of a developer in the developing device is high, in the printer in accordance with the embodiment of the present disclosure.
Figure 10:
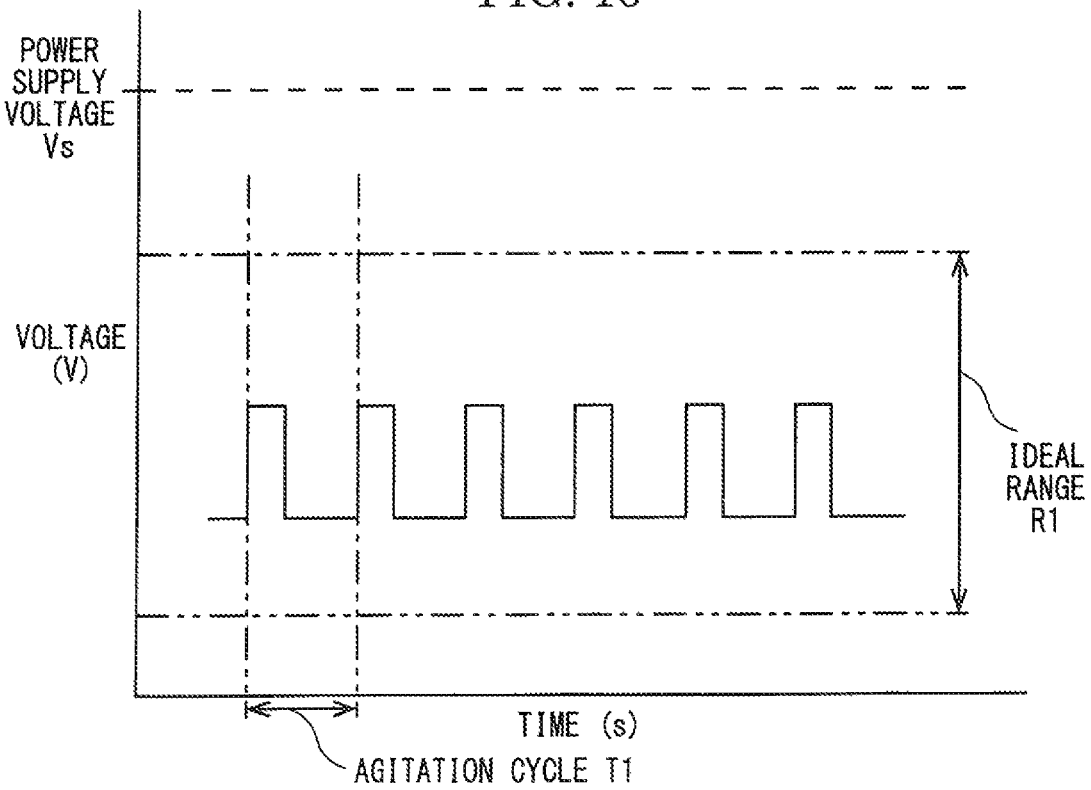
FIG. 10 is a graph plotting the toner sensor output, in a case where the duty ratio of the developer in the developing device is low, in the printer in accordance with the embodiment of the present disclosure.

For example, as shown in FIG. 9, in a case where a period, when the sensor output is the maximum value (HIGH level) or a value approximating to the maximum value, is longer than another period, when the sensor output is the minimum value (LOW level) or a value approximating to the minimum value, in the agitation cycle T1, the duty ratio becomes higher. Since the agitated toner amount is increased when the duty ratio is thus high, the toner amount measured by the toner amount measuring part 46 is increased as the duty ratio becomes higher. On the other hand, as shown in FIG. 10, in a case where the period, when the sensor output is the maximum value or the value approximating to the maximum value, is shorter than the other period, when the sensor output is the minimum value or the value approximating to the minimum value, in the agitation cycle T1, the duty ratio becomes lower. Incidentally, the duty ratio may be calculated by averaging the sensor outputs in the agitation cycle T1 sampled several times.

In accordance with the embodiment, as described above, the toner amount measuring part 46 calculates the duty ratio in respect to the sensor output of the toner sensor 28 in the agitation cycle T1 of the first agitating screw 25 and second agitating screw 26 and measures the toner amount in the housing 20 on the basis of this duty ratio. Thereby, it is possible to correctly measure the toner amount in the housing 20, even if the voltage produced by the magnetic permeability caused by the influence of the external environment is superimposed on the sensor output of the toner sensor 28.

Moreover, in accordance with the embodiment, the sensor output deciding part 44 decides whether or not the sensor output of the toner sensor 28 before the toner agitation is varied and whether or not there is cyclicity in respect to the variation. In the case where the sensor output of the toner sensor 28 before the toner agitation is varied cyclically, the sensor output correcting part 45 corrects the sensor output by subtracting the sensor output before the toner agitation from the sensor output during the toner agitation. Thereby, it is possible to obtain the sensor output of the toner sensor 28, from which the influence of the external environment is removed, and to more correctly measure the toner amount in the housing 20.

Furthermore, in accordance with the embodiment, in the case where the sensor output deciding part 44 decides that the sensor output of the toner sensor 28 before the toner agitation is varied randomly without the cyclicity or that the sensor output is roughly equal to the power supply voltage Vs, the error notification is carried out. Therefore, it is possible to notify the user that external equipment or the like affecting the toner sensor 28 exists near the printer 1.

Although the embodiment was described in a configuration that the present disclosure is applied in the printer using the magnetic single-component toner, the present disclosure is not restricted by the configuration. In another embodiment, the present disclosure may be applied in another printer using two magnetic component developer composed of the toner and magnetic carrier. In the developing device using the two magnetic component developer composed of the toner and magnetic carrier, for example, in contrast to the above-described embodiment, the magnetic permeability becomes lower as the toner is increased, while the magnetic permeability becomes higher as the toner is decreased. Therefore, the sensor output of the toner sensor 28 in the other embodiment becomes the minimum value or the value approximating to the minimum value in the period when the sensor output in the above-described embodiment is the maximum value or a value approximating to the maximum value. The sensor output of the toner sensor 28 in the other embodiment also becomes the maximum value or the value approximating to the maximum value in the period when the sensor output in the above-described embodiment is the minimum value or a value approximating to the minimum value. However, in the other embodiment, the duty ratio of the sensor output of the toner sensor 28 in the agitation cycle T1 of the first agitating screw 25 and second agitating screw 26 is the same as the above-described embodiment.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

a developing device developing an image carrier by a contained developer;

a magnetic permeability detecting part detecting magnetic permeability of the developer in the developing device;

an agitating member rotating in the developing device to agitate the developer;

a detected result deciding part deciding, on the basis of the magnetic permeability detected by the magnetic permeability detecting part before the agitation by the agitating member, whether or not a detected result of the magnetic permeability detecting part is varied cyclically; and a detected result correcting part correcting the detected result of the magnetic permeability detecting part by subtracting the magnetic permeability in a predetermined cycle detected by the magnetic permeability detecting part before the agitation by the agitating member from the magnetic permeability in the predetermined cycle detected by the magnetic permeability detecting part during the agitation by the agitating member, in a case where the detected result deciding part decides that the detected result of the magnetic permeability detecting part is varied cyclically, and a developer amount measuring part calculating a duty ratio of the magnetic permeability of the developer in the developing device on the basis of detected result of the magnetic permeability detecting part corrected by the detected result correcting part and measuring a developer amount in the developing device on the basis of the duty ratio.

2. The image forming apparatus according to claim 1 further comprising:

a controlling part carrying out error notification, in a case where the detected result deciding part decides that the detected result of the magnetic permeability detecting part before the agitation by the agitating member is varied randomly without cyclicity or that the detected result is roughly equal to the power supply voltage.

3. The image forming apparatus according to claim 1, wherein the detected result deciding part monitors the detected result of the magnetic permeability detecting part for a predetermined long time, cuts out a partial arrangement from a piece of monitored data and confirms whether or not there is another arrangement matching to the cutout arrangement, and moreover, if there is the matching arrangement, assuming that a period from the cutout arrangement to the matching arrangement is one cycle, compares one data arrangement corresponding to the one cycle with other data arrangement corresponding to next one cycle, and then, decides, when both data arrangement are roughly equal, that the detected result of the magnetic permeability detecting part is varied cyclically.

4. The image forming apparatus according to claim 1, wherein the detected result deciding part carries out measurement instruction to the developer amount measuring part, in a case where the detected result deciding part decides that since the detected result of the magnetic permeability detecting part before the agitation by the agitating member is not varied and that the detected result is sufficiently less than the power supply voltage.

5. The image forming apparatus according to claim 1, wherein the detected result correcting part obtains the detected result of the magnetic permeability detecting part at the same period as the agitation cycle of the agitating member or period corresponding to several repeats of the agitation cycle and corrects the obtained detected result.

* * * * *